US005456144A

United States Patent [19]

Dahl et al.

[11] Patent Number: 5,456,144

[45] Date of Patent: Oct. 10, 1995

[54] LOCKING PLIERS WITH AXIAL CLAMPING ACTION

[75] Inventors: Raymond Dahl, Cresten, Calif.; Francis Barnes, Odell, Nebr.; Anthony Fuller, DeWitt, Nebr.; Joseph Sorensen, Lincoln, Nebr.

[73] Assignee: Petersen Manufacturing, Lincoln, Nebr.

[21] Appl. No.: 179,744

[22] Filed: Jan. 11, 1994

[51] Int. Cl.[6] ..... B25B 7/12

[52] U.S. Cl. ..... 81/373; 81/352; 81/426.5; 29/268; 269/6

[58] Field of Search ..... 81/352, 363, 367, 81/373, 418, 429.5; 29/268; 269/6, 237

[56] References Cited

U.S. PATENT DOCUMENTS

| | | | |
|---|---|---|---|
| 2,519,630 | 8/1950 | Boyer | 81/373 |
| 2,803,320 | 6/1954 | Wagner . | |
| 3,210,070 | 10/1965 | Lagana | 81/373 X |
| 3,617,044 | 11/1971 | Strang . | |
| 3,908,490 | 9/1975 | Durham . | |
| 4,541,312 | 9/1985 | Petersen . | |
| 4,725,049 | 2/1988 | Cantarinhas | 269/6 |
| 4,776,079 | 10/1988 | Cameron | 81/418 X |
| 4,787,109 | 11/1988 | Bennett et al. . | |
| 4,829,875 | 5/1989 | Green | 81/426.5 |
| 5,101,696 | 4/1992 | Neff . | |
| 5,176,048 | 1/1993 | Jore et al. . | |
| 5,176,049 | 1/1993 | Neff . | |
| 5,193,336 | 3/1993 | King . | |

OTHER PUBLICATIONS

Photograph of a locking pliers identified as GRIP–ON Part No. 928 07.

Two photocopies of prior art device identified as Petersen Mfg. Co., DeWitt, Nebr.

Two photocopies of prior art device identified as Witte (West Germany).

Drawing "Automatic Adjustable Pliers Serrated Jaw Assembly" Texceed Jan. 9, 1994.

A collection of 19 photographs of prior art adjustable wrenches and clamps (undated).

*Primary Examiner*—James G. Smith

*Attorney, Agent, or Firm*—Willian Brinks Hofer Gilson & Lione

[57] ABSTRACT

A pair of locking pliers includes a body having a fixed jaw that supports a fixed extension. A movable jaw is pivotably mounted to the body by a hinge pin, and the movable jaw includes a movable extension. An operating lever is pivotably mounted to the movable jaw to close the movable jaw, and the movable jaw is shaped such that the movable extension slides along the fixed extension as the movable jaw is pivoted closed with the operating lever in order to provide an axial clamping action.

12 Claims, 3 Drawing Sheets

LOCKING PLIERS WITH AXIAL CLAMPING ACTION

BACKGROUND OF THE INVENTION

This invention relates to locking pliers of the type having fixed and movable clamping elements that approach one another in an axial direction as the pliers are closed.

Locking pliers are known in which fixed and movable clamping elements approach one another in an axial direction as the pliers are closed. Such pliers in the past have been referred to as axial clamps. The axial clamps known to the inventors have provided an axially oriented shaft on the body of the pliers and a sleeve on the movable clamping element. As the pliers are closed the sleeve is moved axially along the shaft to cause the fixed and movable clamping elements to approach one another.

This prior art arrangement relies on a telescoping or sliding action between the fixed and movable clamping elements of the pliers. This is in contrast to a conventional locking pliers such as that shown in U.S. Pat. No. 4,541,312, in which the movable jaw is pivotably mounted with respect to the body to pivot the movable clamping element toward the fixed clamping element in a circumferential rather than an axial direction. It would be advantageous if an axial clamp could be formed in such a way as to eliminate the need for the telescoping sleeve of the prior art.

SUMMARY OF THE INVENTION

According to this invention, locking pliers are provided comprising a body having a fixed jaw fixedly positioned with respect to the body. This fixed jaw comprises a fixed extension which in turn comprises a fixed clamping element. A movable jaw is pivotably mounted to the body by a hinge pin, and this movable jaw comprises a movable extension which in turn comprises a movable clamping element. An operating lever is pivotably mounted to the movable jaw, and an over-center locking linkage is coupled between the operating lever and the body to hold the operating lever and the movable jaw closed, with the fixed and movable clamping elements in opposed, clamping relationship. The movable jaw is shaped to provided an axial clamping action such that the movable extension slides along the fixed extension as the movable jaw is pivoted closed with the operating lever.

In alternative embodiments of this invention the movable extension can either be fixedly or movably mounted to the movable jaw. In the first case, either the body or the movable jaw defines an elongated slot that receives the hinge pin, and the slot allows the movable jaw both to pivot and to translate as the movable jaw is closed. In the second case, the movable jaw extension is biased into sliding contact with the fixed extension by closing a spring as the movable jaw is closed.

DETAILED DESCRIPTION OF THE PRESENTLY PREFERRED EMBODIMENTS

Figure 1:
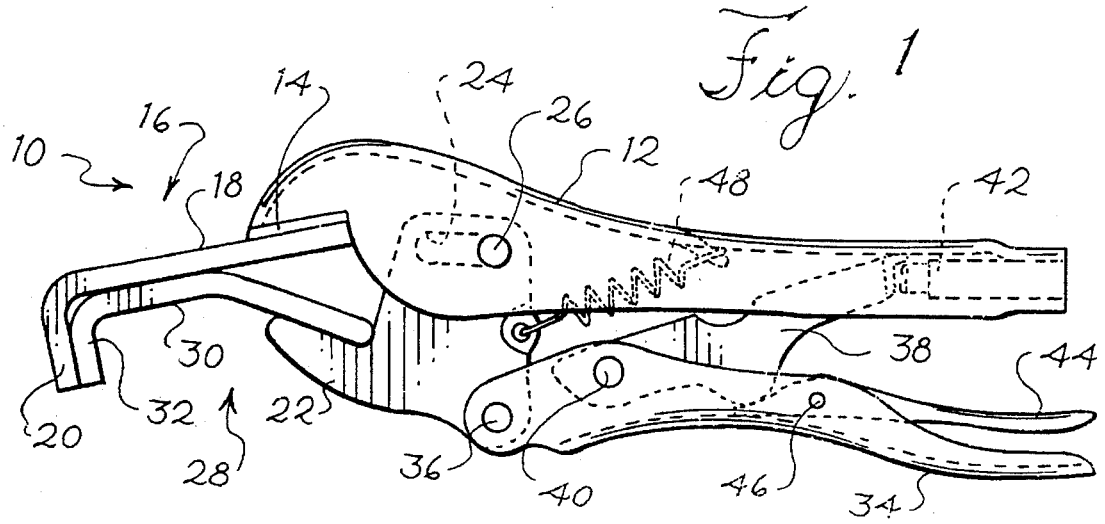
FIG. 1 is a side view of a pair of locking pliers which incorporates a first preferred embodiment of this invention, showing the pliers in a closed position.
Figure 2:
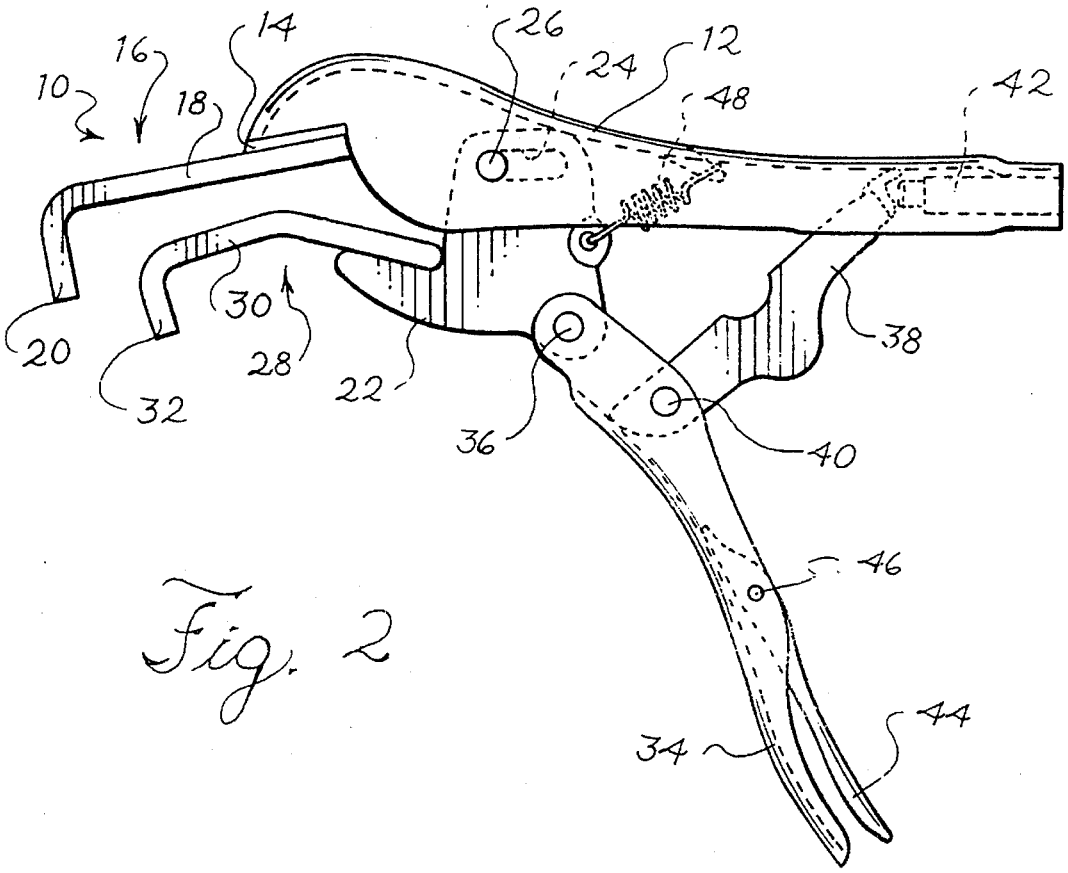
FIG. 2 is a side view of the embodiment of FIG. 1 showing the pliers in an opened position.

Turning now to the drawings, FIGS. 1 and 2 show two views of a pair of locking pliers 10 which incorporates a first preferred embodiment of this invention. The locking pliers 10 include a body 12 which terminates at one end in a fixed jaw 14. A fixed extension 16 is rigidly secured to the fixed jaw 14, as for example by welding. This fixed extension 16 is generally L-shaped in side view and generally rectangular in top view, and it includes first and second fixed segments 18, 20. The first fixed segment 18 is secured to the fixed jaw 14, and the second fixed segment 20 extends out of the plane of the first fixed segment to define a fixed clamping element.

The locking pliers 10 also include a movable jaw 22 that is mounted for pivotal movement with respect to the body 12 about a hinge pin 26 that is received in an elongated slot 24 defined by movable jaw 22. Thus, the movable jaw 22 pivots with respect to the body 12 about the hinge pin 26, and the movable jaw 22 translates with respect to the body 12 as the elongated slot 24 moves with respect to the hinge pin 26. Alternately, the slot 24 can be formed in the body 12.

The movable jaw 22 includes a movable extension 28 which is generally L-shaped in side view and generally rectangular in top view, and it is made up of first and second movable segments 30, 32. The first movable segment 30 is rigidly secured to the movable jaw 22, as for example by welding. The second movable segment 32 extends as shown in FIG. 1 to define a movable clamping element. When the locking pliers 10 are closed as shown in FIG. 1, the fixed and movable clamping elements defined by the segments 20, 32 are in opposed, clamping relationship, well suited for clamping a workpiece therebetween.

An operating lever 34 is pivotably mounted to the movable jaw 22 by a pivot pin 36. An over-center locking linkage comprising a stub shaft 38 is pivotably mounted to the operating lever 34 by a pivot pin 40. The end of the stub shaft 38 remote from the pivot pin 40 bears on an adjustable stop 42 which in this embodiment is the free end of a screw adjust element that is threaded in place on the body 12. The longitudinal axis of the adjustable stop 42 is generally aligned with the longitudinal axis of the body 12, and in the closed position the elongated slot 24 is oriented to extend generally parallel to this axial direction.

A release lever 44 is pivotably mounted to the operating lever 38 by a pivot pin 46, and the release lever 44 bears on the stub shaft 38 to release the over-center locking linkage in the conventional manner. An opening spring 48 is mounted between the movable jaw 22 and the body 12 to bias the movable jaw 22 in the counter-clockwise direction as shown in FIG. 1 to open the pliers 10. The operation of the over-center locking linkage, the operating lever 34, the adjustable stop 42, the release lever 44, the opening spring 48, and the associated parts of the body 12, are all conventional, and therefore do not require further discussion. See, for example the pliers described in U.S. Pat. No. 4,541,312, which clarifies that the body is U-shaped in cross-section, and that the movable jaw, opening spring, stub shaft, and adjustable stop are all mounted within the body.

FIG. 2 shows the locking pliers 10 in the opened position. Note that the operating lever 34 has been moved away from the body 12, and that the opening spring 48 has rotated the movable jaw 22 in the counter-clockwise direction.

In order to close the locking pliers 10 from the opened position of FIG. 2, the operating lever 34 is moved toward the body 12. This action initially rotates the movable jaw 22 in the clockwise direction until the movable extension 28 comes into sliding contact with the fixed extension 16. Further movement of the operating lever 34 causes the movable extension 28 to slide along the fixed extension 16 and to move the movable clamping element formed by the second movable segment 32 toward the fixed clamping element formed by the second fixed segment 20. Note that the clamping action is generally axial, with the movable clamping element moving in a direction substantially parallel to the axial direction defined by the body 12. This axial movement of the movable clamping element with respect to the fixed clamping element is made possible by the elongated slot 24 which slides in translation with respect to the hinge pin 26 as the movable jaw 22 is closed.

Figure 3:
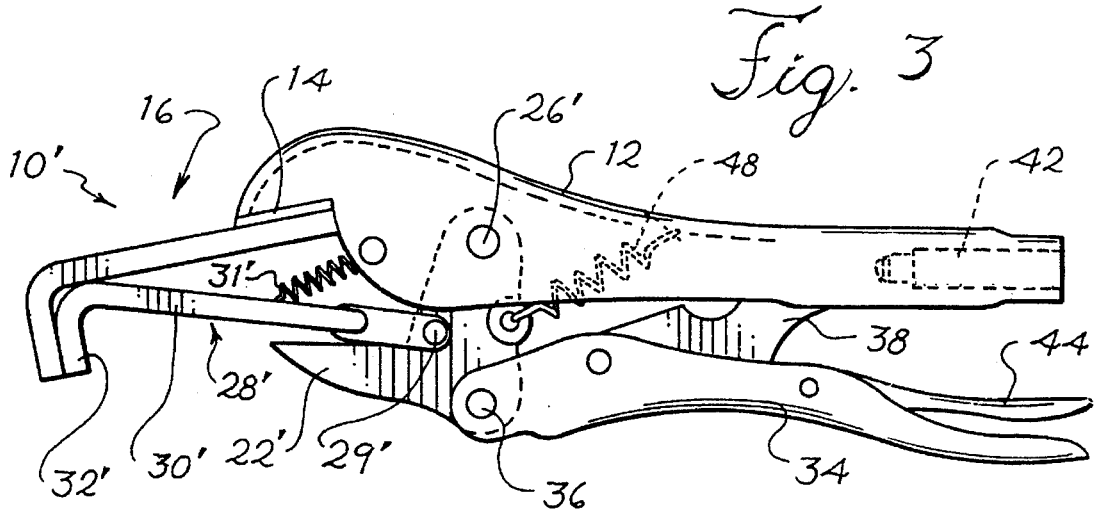
FIG. 3 is a side view of a pair of locking pliers which incorporates a second preferred embodiment of this invention, showing the pliers in a closed position.
Figure 4:
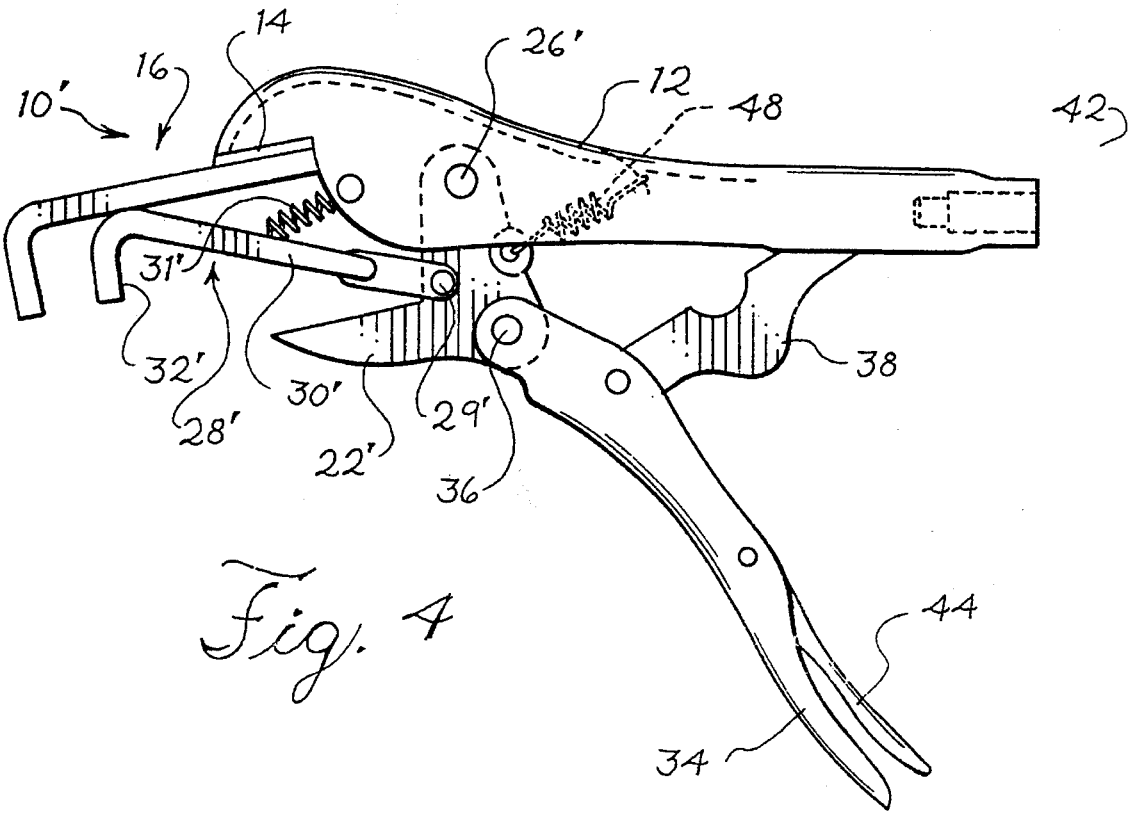
FIG. 4 is a side view of the embodiment of FIG. 3 showing the pliers in an opened position.

FIGS. 3 and 4 provide two views of a pair of locking pliers 10' which incorporates a second preferred embodiment of this invention. The body 12, fixed jaw 14, fixed extension 16, operating lever 34, stub shaft 38, adjustable stop 42, release lever 44 and opening spring 48 are all identical in both embodiments, and therefore no further explanation is required.

The locking pliers 10' differ from the locking pliers 10 primarily in the construction of the movable jaw and the movable extension. As shown in FIG. 3, the movable jaw 22' is pivoted about the hinge pin 26' in a manner that prevents longitudinal sliding movement between the movable jaw 22' and the body 12. Note that there is no elongated slot of the type described above in the movable jaw 22'. Also, the movable extension 28' as before comprises a first segment 30' and a second segment 32'. In this case the movable extension 28' is pivotably mounted to the movable jaw 22' by a pivot pin 29'. A closing spring 31' is secured between the movable extension 28' and the body 12. This closing spring 31' biases the movable extension 28' toward the fixed extension 16.

FIG. 4 shows the locking pliers 10' in an opened position. Note that the closing spring 31' maintains the movable extension 28' in sliding contact with the fixed extension 16. As the operating lever 34 is closed, the movable jaw 22' is pivoted in the clockwise direction about the hinge pin 26'. The movable extension 28' pivots as necessary about the pivot pin 29' to maintain the movable extension 28' in sliding contact with the fixed extension 16 as the movable jaw 22' closes. The second movable segment 32' which forms the movable clamping element moves in a generally axial direction (generally aligned with the longitudinal axis defined by the body 12) as the movable clamping element moves to the closed position.

In both embodiments the adjustable stop 42 can be rotated to adjust its axial position in the body 12. In this way the locking pliers 10, 10' can be adjusted to provide the desired axial separation between the opposed clamping elements when the locking pliers are fully closed.

Figure 5:
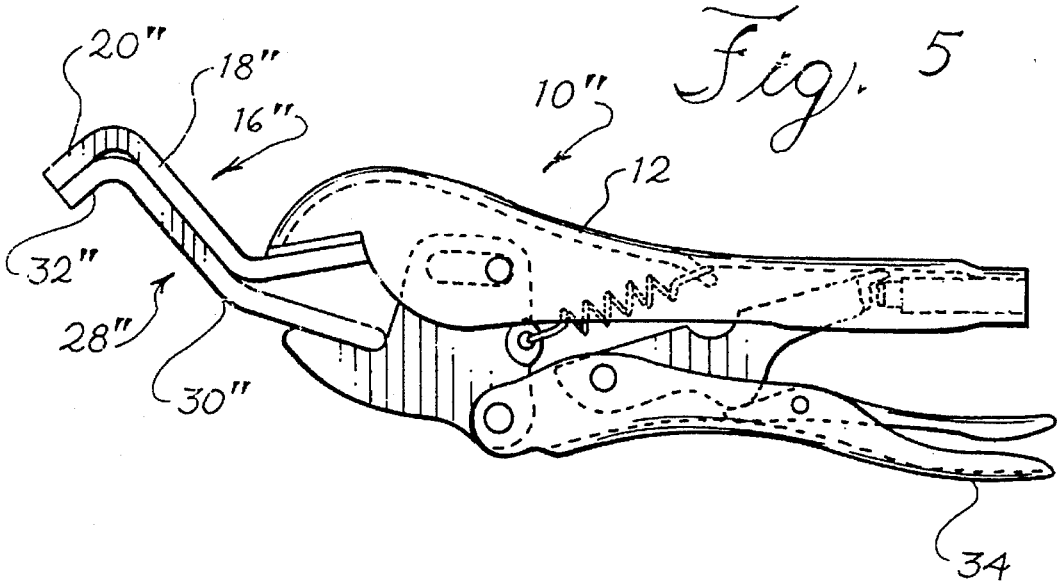
FIG. 5 is a side view of a pair of locking pliers which incorporates a third preferred embodiment of this invention, showing the pliers in a closed position.
Figure 6:
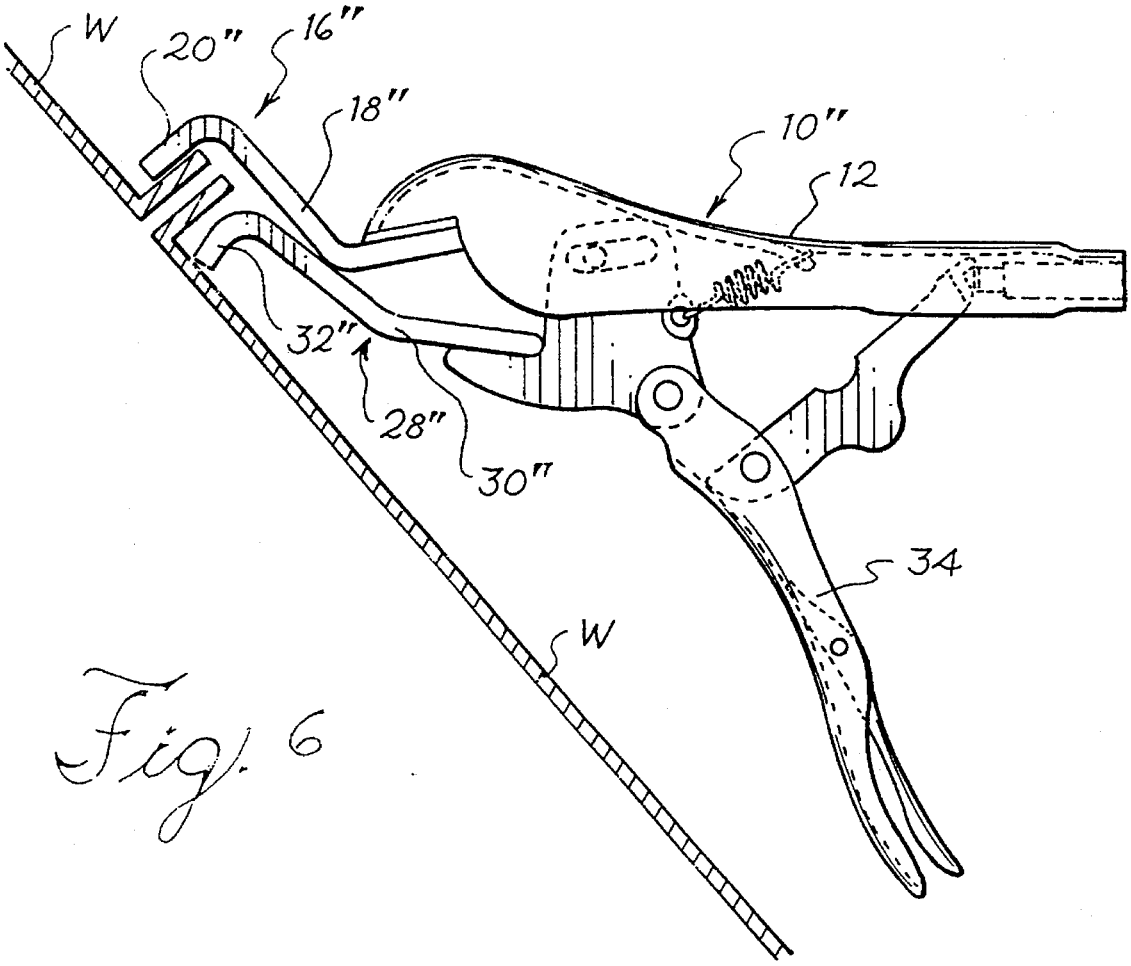
FIG. 6 is a side view of the embodiment of FIG. 5 showing the pliers in an opened position.

FIGS. 5 and 6 show two views of a third preferred embodiment 10" of this invention. This third preferred embodiment 10" is similar to the first preferred embodiment 10 described above, except that the extensions 16", 28" are bent as shown in FIGS. 5 and 6. This arrangement allows the operating lever 34 to be spaced a greater distance from the workpiece W to facilitate operation of the pliers 10".

In the embodiment 10" the axial direction in which the segment 32" approaches the segment 20" is angled with respect to the longitudinal axis of the body 12" by an angle equal to the bend in the extensions 16", 28".

The locking pliers 10, 10', 10" are useful in many applications where it is desired to have the opposed clamping elements approach one another in an axial manner. These pliers 10, 10', 10" can be used for example in welding operations, where it is desired to secure two pieces of sheet metal together for welding. The right angle configuration of the illustrated extensions allows the locking pliers 10, 10', 10" to be used in situations where the locking pliers are best positioned out of the plane of the sheet metal being welded.

Of course, it should be understood that a wide range of changes and modifications can be made to the preferred embodiments described above. For example, the fixed and movable extensions can be provided with a horseshoe shape if desired to provide two clamping regions spaced from one another along a direction transverse to the axial direction described above. Additionally, it may be advisable in some applications to alter the shape of the extensions, as for example to allow a workpiece to extend out of the opposed clamping elements on the body side rather than the operating lever side of the locking pliers. The included angle between the first and second segments 18, 20; 30, 32 can differ from the 90° angle shown, and can be 120°–135° for example. It is therefore intended that the foregoing detailed description be regarded as illustrative rather than limiting, and that it be understood that it is the following claims, including all equivalents, which are intended to define the scope of this invention.

We claim:

1. A locking pliers comprising:

a body comprising a fixed jaw fixedly positioned with respect to the body, said fixed jaw comprising a fixed extension which in turn comprises a fixed clamping element;

a movable jaw mounted to the body to pivot about a hinge pin, said movable jaw comprising a movable extension which in turn comprises a movable clamping element;

an operating lever pivotably mounted to the movable jaw;

an over-center locking linkage coupled between the operating lever and the body to hold the operating lever and the movable jaw closed, with the fixed and movable clamping elements in opposed, clamping relationship;

wherein the movable extension is pivotably mounted to the movable jaw, and wherein the invention further comprises a closing spring mounted to the movable extension to bias the movable extension into contact with the fixed extension as the movable jaw is closed.

2. A locking pliers comprising:

a body comprising a fixed jaw fixedly positioned with respect to the body, said fixed jaw comprising a fixed extension which in turn comprises a fixed clamping element;

a movable jaw mounted to the body to pivot about a hinge pin, said movable jaw comprising a movable extension which in turn comprises a movable clamping element;

an operating lever pivotably mounted to the movable jaw;

an over-center locking linkage coupled between the operating lever and the body to hold the operating lever and the movable jaw closed, with the fixed and movable clamping elements in opposed, clamping relationship;

wherein the movable extension is fixedly positioned with respect to the movable jaw, wherein one of the body and the movable jaw defines an elongated slot, and wherein the hinge pin passes through the slot such that during closing the movable jaw moves with respect to the hinge pin, and the movable jaw translates with respect to the body as the slot moves with respect to the hinge pin, said slot oriented such that the movable extension slides along the fixed extension as the movable jaw is pivoted closed with the operating lever, thereby providing an axial clamping action.

3. The invention of claim 2 wherein the movable jaw defines the elongated slot.

4. The invention of claim 1 or 2 further comprising an opening spring mounted between the movable jaw and the body to bias the movable jaw open.

5. The invention of claim 1 or 2 wherein the fixed extension comprises a first fixed segment secured to the fixed jaw and a second fixed segment secured to the first fixed segment at a point remote from the fixed jaw, wherein the movable extension comprises a first movable segment secured to the movable jaw and a second movable segment secured to the first movable segment at a point remote from the movable jaw, wherein the fixed clamping element comprises the second fixed segment, and wherein the movable clamping element comprises the second movable segment.

6. The invention of claim 5 wherein the fixed and movable extensions are generally L-shaped in side view, with the first fixed segment oriented generally parallel to the first movable segment and the second fixed segment oriented generally parallel to the second movable segment when the movable jaw is closed.

7. A locking pliers comprising:

a body comprising a fixed jaw fixedly positioned with respect to the body, said fixed jaw comprising a fixed extension which in turn comprises a fixed clamping element;

a movable jaw mounted to the body to pivot about a hinge pin, said movable jaw comprising a movable extension which in turn comprises a movable clamping element;

an operating lever pivotably mounted to the movable jaw;

an over-center locking linkage coupled between the operating lever and the body to hold the operating lever and the movable jaw closed, with the fixed and movable clamping elements in opposed, clamping relationship;

said movable jaw defining an elongated slot, said body mounting the hinge pin, and said hinge pin received in the slot;

an opening spring coupled between the movable jaw and the body to bias the movable jaw open with the hinge pin positioned at a first end of the slot;

said slot positioned such that movement of the operating lever to close the movable jaw moves the movable jaw with respect to the hinge pin to cause the movable extension to slide along the fixed extension as the slot translates with respect to the hinge pin and the movable clamping element approaches the fixed clamping element.

8. A locking pliers comprising:

a body comprising a fixed jaw fixedly positioned with respect to the body, said fixed jaw comprising a fixed extension which in turn comprises a fixed clamping element;

a movable jaw mounted to the body to pivot about a hinge pin, said movable jaw comprising a movable extension which in turn comprises a movable clamping element;

an operating lever mounted to the movable jaw to pivot about a first pivot pin;

an over-center locking linkage coupled between the operating lever and the body to hold the operating lever and the movable jaw closed, with the fixed and movable clamping elements in opposed, clamping relationship;

said fixed extension rigidly secured to said fixed jaw;

said movable extension pivotably mounted to said movable jaw by a second pivot pin disposed between the hinge pin that couples the movable jaw to the body and the first pivot pin that couples the movable jaw to the operating lever; and a closing spring coupled to the movable extension to bias the movable extension into contact with the fixed extension as the movable jaw is closed such that movement of the movable jaw about the hinge pin causes the movable extension to slide along the fixed extension as the movable jaw is closed.

9. The invention of claim 7 or 8 wherein the fixed extension comprises a first fixed segment secured to the fixed jaw and a second fixed segment secured to the first fixed segment at a point remote from the fixed jaw, wherein the movable extension comprises a first movable segment secured to the movable jaw and a second movable segment secured to the first movable segment at a point remote from the movable jaw, wherein the fixed clamping element comprises the second fixed segment, and wherein the movable clamping element comprises the second movable segment.

10. The invention of claim 9 wherein the fixed and movable extensions are generally L-shaped in side view, with the first fixed segment oriented generally parallel to the first movable segment and the second fixed segment oriented generally parallel to the second movable segment when the movable jaw is closed.

11. The invention of claim 7 or 8 wherein the fixed and movable extension are bent to offset the clamping elements with respect to the body when the movable jaw is closed.

12. The invention of claim 2 or 7 wherein the body defines an axial direction extending along a length of the body, wherein the slot defines a length direction, and wherein the length direction of the slot is generally parallel to the axial direction.

* * * * *